US009982949B2

(12) United States Patent
Yamashita

(10) Patent No.: US 9,982,949 B2
(45) Date of Patent: May 29, 2018

(54) HEAT PIPE HAVING WICK FORMED WITH HYDROPHILIC AND WATER-REPELLENT TREATED SURFACES

(71) Applicant: TOYOTA JIDOSHA KABUSHIKI KAISHA, Toyota-shi, Aichi-ken (JP)

(72) Inventor: Seiji Yamashita, Gotenba (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 245 days.

(21) Appl. No.: 14/658,292

(22) Filed: Mar. 16, 2015

(65) Prior Publication Data

US 2015/0285563 A1 Oct. 8, 2015

(30) Foreign Application Priority Data

Apr. 8, 2014 (JP) ..... 2014-079204
Dec. 17, 2014 (JP) ..... 2014-255621

(51) Int. Cl.
*F28D 15/04* (2006.01)
*F28D 15/02* (2006.01)

(52) U.S. Cl.
CPC ..... *F28D 15/046* (2013.01); *F28D 15/0233* (2013.01); *F28F 2245/02* (2013.01); *F28F 2245/04* (2013.01)

(58) Field of Classification Search
CPC .. F28D 15/0266; F28D 15/0233; F28D 15/04; F28D 15/046; F28D 15/02; B23P 15/26; F28F 13/182; F28F 13/185; F28F 13/187; F28F 2245/02; F28F 2245/04
USPC ..... 165/104.21, 104.26, 133; 29/890.032
See application file for complete search history.

(56) References Cited

U.S. PATENT DOCUMENTS 3,283,787 A * 11/1966 Davis ..... B43K 8/02 138/148
3,757,955 A * 9/1973 Leonard ..... B01D 63/14 210/321.77
3,822,743 A * 7/1974 Waters ..... F28D 15/046 122/366
3,901,311 A * 8/1975 Kosson ..... F28D 15/046 122/366
4,003,427 A * 1/1977 Leinoff ..... F28D 15/046 122/366

(Continued)

FOREIGN PATENT DOCUMENTS

CN 201407935 Y 2/2010
JP 2002-81875 A 3/2002

(Continued)

*Primary Examiner* — Grant Moubry
*Assistant Examiner* — Jose O Class-Quinones
(74) *Attorney, Agent, or Firm* — Sughrue Mion, PLLC

(57) ABSTRACT

A heat pipe provided inside with a wick formed of a porous membrane having a hydrophilic treated first surface and a water-repellent treated second surface, wherein the porous membrane separates a working fluid passage from a vapor passage such that the hydrophilic treated surface faces the working fluid passage and the water-repellent treated surface faces the vapor passage, and a heat pipe provided inside with a wick formed by laminating at least two porous membranes each having a hydrophilic treated first surface and a water-repellent treated second surface such that surfaces subjected to the same treatment face each other and the laminate is wound up.

4 Claims, 4 Drawing Sheets

(56) References Cited

U.S. PATENT DOCUMENTS 4,019,571 A * 4/1977 Kosson ..... F28D 15/046 122/366
4,108,239 A * 8/1978 Fries ..... F28D 15/046 165/104.26
4,186,796 A * 2/1980 Usui ..... F28D 15/046 138/40
4,855,058 A * 8/1989 Holland ..... B01D 53/22 210/321.74
6,168,648 B1 * 1/2001 Ootani ..... B01D 19/0031 210/321.76
6,896,040 B2 * 5/2005 Hul-Chun ..... F28D 15/046 165/104.21
7,025,797 B2 * 4/2006 Zettel ..... B01D 25/001 55/282.3
7,143,817 B2 * 12/2006 Li ..... F28D 15/046 165/104.26
7,367,383 B2 * 5/2008 Li ..... F28D 15/046 165/104.26
2001/0004934 A1 * 6/2001 Yamamoto ..... F28D 15/0233 165/104.11
2003/0010476 A1 * 1/2003 Gippert ..... A61M 16/18 165/104.26
2007/0151703 A1 * 7/2007 Touzov ..... A41D 13/0051 165/45
2008/0032169 A1 * 2/2008 Fabian ..... H01M 8/023 429/414
2009/0056917 A1 * 3/2009 Majumdar ..... F28D 15/0233 165/104.26
2010/0096113 A1 * 4/2010 Varanasi ..... F28F 13/187 165/133
2011/0017431 A1 * 1/2011 Yang ..... F28D 15/046 165/104.26
2012/0111539 A1 * 5/2012 Dai ..... F28D 15/046 165/104.26

FOREIGN PATENT DOCUMENTS

JP 2004-28406 A 1/2004
JP 2006526128 A 11/2006

* cited by examiner

HEAT PIPE HAVING WICK FORMED WITH HYDROPHILIC AND WATER-REPELLENT TREATED SURFACES

TECHNICAL FIELD

The present invention relates to heat pipe provided inside with a wick, more specifically to a heat pipe that can achieve an improved emission limit by including a wick made of a specific base material.

BACKGROUND ART

Heat pipes provided with a wick have been developed, and wick materials of various shapes are known, such as gauze-like materials, fibrous materials, and porous materials. In such a heat pipe, vapor from a working fluid travels in a specific direction of the pipe, and a condensate liquid of the working fluid is refluxed in the opposite direction through capillary action. This evaporation-condensation cycle repeats. However, for such heat pipes provided with a wick, there is the problem of a limit on emission of a refluxed working fluid due to working vapor.

To solve this problem, various proposals have been made for the structure of a heat pipe provided with a wick.

For example, Patent Document 1 discloses a flat heat pipe having a grooved wick on its inner wall and having a flat cross-sectional shape, wherein at least one linear auxiliary wick extending along the axis is disposed at both inner ends of the flat cross-section in the width direction.

Patent Document 2 discloses a heat pipe including a working fluid that is filled in a container and repeats evaporation and condensation, and a thin wick configured to transfer the working fluid from a cooling end to a heating end, wherein the wick is disposed along and near/abutting the inner wall surface of the container; innumerable groove-like passages are formed on at least a side opposite to the inner wall surface of the container along the direction from the cooling end to the heating end; and the outer sides of flat portions of the wick are hydrophilic treated.

Unfortunately, according to the techniques disclosed in these prior art documents, when the relative velocity between a vapor flow and a working fluid in a wick is high, an emission limit is reached where some emissions from the working fluid do not return to an evaporation unit, resulting in a low maximum heat transfer rate.

PRIOR ART DOCUMENTS

Patent Documents

Patent Document 1: Japanese Laid-open Patent Publication No. 2002-081875

Patent Document 2: Japanese Laid-open Patent Publication No. 2004-028406

SUMMARY OF THE INVENTION

Problems to be Solved by the Invention

An object of the present invention is to provide a heat pipe that can achieve an improved emission limit compared to those of conventional heat pipes.

Means for Solving the Problems

A first invention relates to a heat pipe provided inside with a wick formed of a porous membrane having a hydrophilic treated first surface and a water-repellent treated second surface, wherein the porous membrane separates a working fluid passage from a vapor passage such that the hydrophilic treated surface faces the working fluid passage and the water-repellent treated surface faces the vapor passage.

A second invention relates to a heat pipe provided inside with a wick formed by laminating the at least two porous membranes each having a hydrophilic treated first surface and a water-repellent treated second surface such that surfaces subjected to the same treatment face each other and winding up the laminate.

A third invention relates to a heat pipe provided inside with a wick formed by folding the porous membrane having a hydrophilic treated first surface and a water-repellent treated second surface multiple times such that surfaces subjected to the same treatment face each other.

A fourth invention relates to a heat pipe provided inside with a wick formed by folding the porous membrane having a hydrophilic treated first surface and a water-repellent treated second surface such that surfaces subjected to the same treatment face each other and winding up the folded porous membrane.

Effects of the Invention

According to the present invention, a heat pipe can be obtained that can achieve an improved emission limit compared to those of conventional heat pipes.

BRIEF DESCRIPTION OF THE DRAWINGS

FIG. 2(*a*) illustrates a schematic cross-sectional view, and FIG. 2(*b*) illustrates an enlarged view thereof.

MODE FOR CARRYING OUT THE INVENTION

The embodiments of the present invention will now be described in detail with reference to the drawings.

Figure 1:
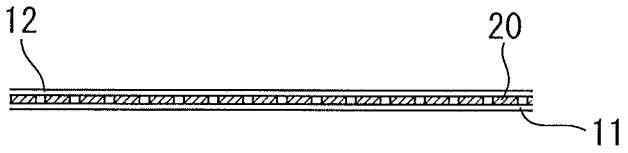
FIG. 1 is schematic view of a porous membrane used for a wick constituting the heat pipe according to the embodiments of the first to fourth inventions.

A porous membrane 20 used for a wick constituting the heat pipe according to the embodiments of the first to fourth inventions, as illustrated in FIG. 1, has a hydrophilic treated first surface 11 and a water-repellent treated second surface 12.

The heat pipe according to the first invention is provided inside with a wick formed of the porous membrane 20 having a hydrophilic treated first surface and a water-repellent treated second surface, wherein the porous membrane separates a working fluid passage from a vapor passage such that the hydrophilic treated surface faces the working fluid passage and the water-repellent treated surface faces the vapor passage, and preferably, at least a portion of the porous membrane is folded.

The heat pipe according to the embodiment of the first invention, in which a working fluid, such as water or alcohol, exists on the hydrophilic treated surface of the wick provided inside, whereas vapor alone exists on the water-repellent treated surface which the working fluid is not able to enter, and thus the vapor passage can be separated from the working fluid passage by the porous membrane, can achieve an improved emission limit, leading to an improved transfer limit.

Figure 2:
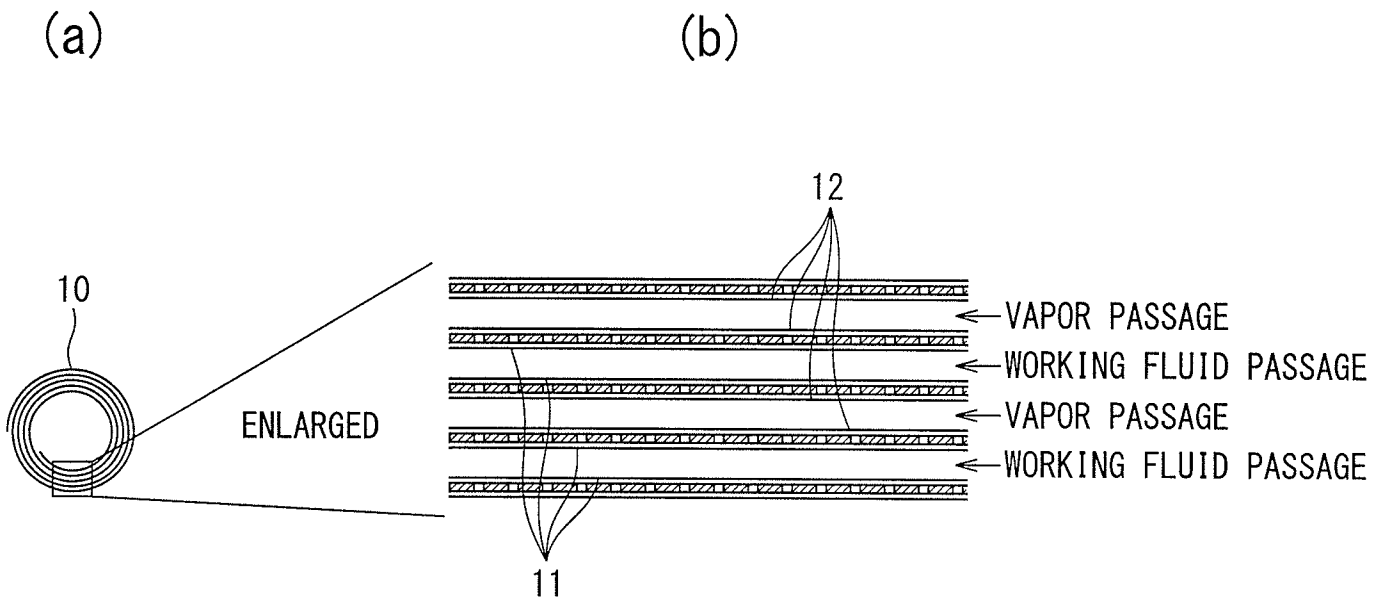
FIG. 2 is a schematic view for illustrating a wick constituting the heat pipe according to the embodiment of the second invention.

The heat pipe according to the embodiment of the second invention, as illustrated in FIG. 2, is provided inside with a wick 10 formed by laminating the at least two porous membranes 20 such that surfaces subjected to the same treatment, for example, hydrophilic treated surfaces 11, face each other and winding up the laminate.

The heat pipe according to the embodiment of the second invention, in which as illustrated in FIG. 2(*b*), a working fluid, such as water or alcohol, exists in a region sandwiched between the hydrophilic treated surfaces 11 of the wick provided inside, whereas vapor alone exists in a region sandwiched between the water-repellent treated surfaces 12 which region the working fluid is not able to enter, and thus the membranes separate a vapor passage from a working fluid passage, can achieve an improved emission limit, leading to an improved transfer limit.

Figure 3:
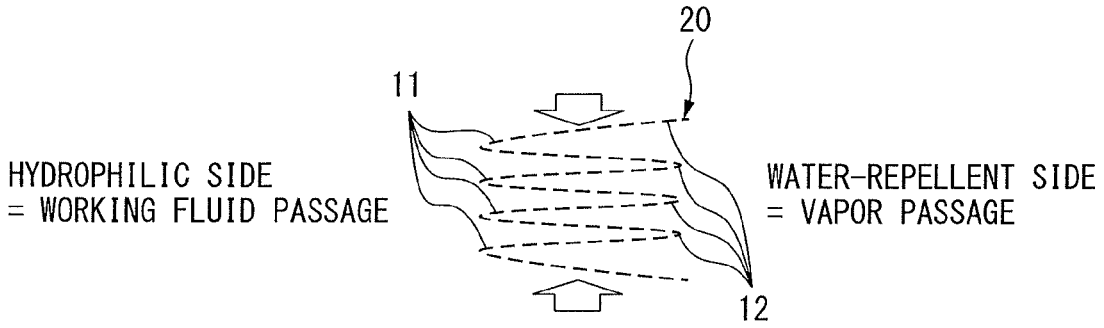
FIG. 3 is schematic cross-sectional view for illustrating a wick constituting the heat pipe according to the embodiment of the third invention.

The wick constituting the heat pipe according to the embodiment of the third invention, as illustrated in FIG. 3, is formed by receiving external pressure to fold the porous membrane 20 having the hydrophilic treated first surface 11 and the water-repellent treated second surface 12 multiple times (e.g., an even number of times from two to ten times, and typically, four times) such that surfaces subjected to the same treatment face each other.

Figure 4:
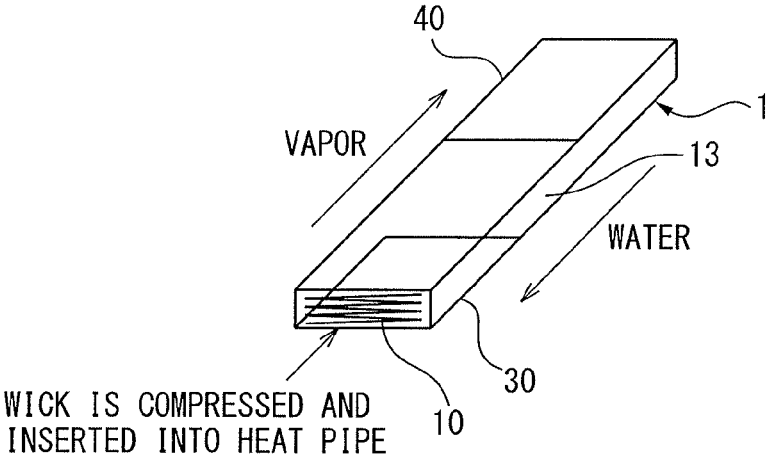
FIG. 4 is a schematic view for illustrating the heat pipe according to the embodiment of the third invention.

A heat pipe 1 according to the embodiment of the third invention, as illustrated in FIG. 4, includes a casing 13 and the wick 10 inserted therein which is formed by the method described above and compressed.

The heat pipe according to the embodiment of the third invention, in which a vapor passage at the water-repellent surface and a working fluid passage at the hydrophilic surface are separated in two directions, can achieve a significantly reduced airflow resistance between the vapor and the working fluid when a boiling surface is provided at the vapor side and a condensation surface at the working fluid side, i.e., a heating unit 30 is an evaporation unit and a cooling unit 40 is a condensation unit. For example, a flat-plate heat pipe illustrated in FIG. 4, in which passage spaces are easy to retain compared to the structure of the second invention, can achieve a further reduced airflow resistance, which allows a further improvement in emission limit.

Figure 5:
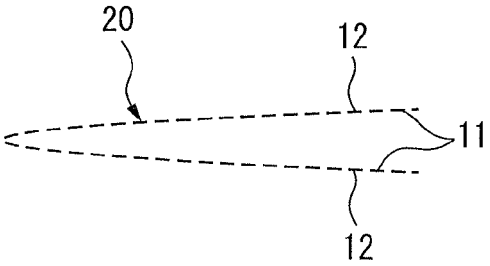
FIG. 5 is a schematic cross-sectional view for illustrating a wick constituting the heat pipe according to embodiment of the fourth invention.
Figure 6:
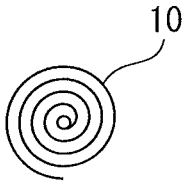
FIG. 6 illustrates an enlarged schematic cross-sectional view of a wick constituting the heat pipe according to embodiment of the fourth invention.

The wick constituting the heat pipe according to embodiment of the fourth invention, as illustrated in FIG. 5, is formed by folding the porous membrane 20 having the hydrophilic treated first surface 11 and the water-repellent treated second surface 12 such that surfaces subjected to the same treatment, e.g., the hydrophilic treated surfaces, face each other and winding up the folded porous membrane as illustrated in FIG. 6.

Figure 7:
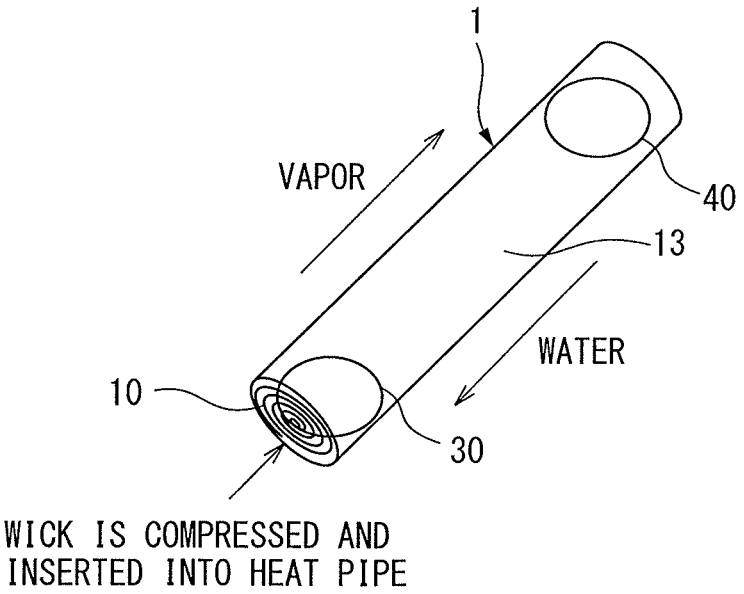
FIG. 7 is a schematic view for illustrating the heat pipe according to the embodiment of the fourth invention.

The heat pipe 1 according to the embodiment of the fourth invention, as illustrated in FIG. 7, includes the casing 13 and the wick 10 inserted therein which is formed by the method described above and compressed.

In the heat pipe according to the embodiment of the fourth invention, one end of a working fluid passage at the hydrophilic surface is closed, and when a boiling surface is provided at the vapor side and a condensation surface at the working fluid side, i.e., the heating unit 30 is an evaporation unit and the cooling unit 40 is a condensation unit, the working fluid is unlikely to leak into a vapor passage. For example, a pipe-shaped heat pipe illustrated in FIG. 7 can achieve a further improvement in emission limit compared to the structure of the second invention.

In the heat pipe according to the embodiments of the present invention, the unclosed end of the wick may be closed by heat sealing using a heat-resistant heat-sealable polymer, such as thermoplastic polyimide, polyamide-imide, or epoxy resin. This closing may be carried out by using the heat-resistant heat-sealable polymer alone, or by heat sealing the end using the heat-resistant heat-sealable polymer via a heat-resistant film such as a heat-resistant resin film or metal foil (e.g., a polyamide film, a polyester film, or a polyimide film).

Examples of the hydrophilic treatment of the wick in the embodiments of the present invention include, but are not limited to, grafting, coating, and oxidation.

The grafting is a treatment of reacting radicals generated in a polymer molecule by irradiation of the porous membrane with monomers having a hydrophilic functional group.

The coating is a treatment of coating the porous membrane with an agent or a polymer having self-hydrophilicity to form a hydrophilic coat layer on the surface layer of a polymer matrix.

The oxidation is a treatment of introducing an oxygen-containing functional group directly into polymer molecules constituting the porous membrane using an oxidizing agent such as ozone or an acid or using ultraviolet rays or plasma.

The water-repellent treatment of the wick in the embodiments of the present invention can be carried out by any method, for example, using a commercially available fluorine-based or silicone-based water-repellent agent by blowing or applying the water-repellent agent itself, or dissolved or suspended in water or an organic solvent to one surface of the porous membrane.

Examples of the porous membrane in the embodiments of the present invention include porous membranes made of a heat-resistant resin such as polyamide-imide, polyamide, polyimide, polycarbonate, polyacetal, polyphenylene ether, polyvinylidene fluoride, polytetrafluoroethylene, polyether ketone, polyethylene terephthalate, polysulfone, polyester, or polyacrylonitrile, and polyimide porous membranes are preferred.

The porous membrane may have a thickness in the range of 10 to 100 μm, e.g., 25 to 75 μm, and pores with a diameter in the range of 0.1 to 2 mm, e.g., 0.2 to 1.5 mm, formed at a pitch in the range of 0.1 to 10 mm, e.g., 1 to 5 mm.

For the wick in the embodiments of the present invention, the distance between the porous membranes can be controlled to be 0.1 to 2 mm according to the height of approximately 0.1 to 2 mm of the protrusions formed on the membrane.

According to the embodiments of the present invention, a heat pipe can be obtained that can achieve an improved emission limit compared to those of conventional heat pipes.

EXAMPLE

An example of the present invention will now be described.

It should be understood that the example described below is for the purpose of demonstrating the process of manufacturing a wick in the heat pipe of the present invention, and not intended to limit the present invention.

Example 1

Manufacturing Wick by Winding Up Hydrophilic/Water-Repellent Treated Porous Membrane Two porous membranes (50-μm thick polyimide films in which pores with a diameter of 1 mm are formed at a pitch of 2 mm with a press) are prepared, each having a hydrophilic treated thiol self-assembled monolayer (SAM) on one surface and a water-repellent treated fluorine layer on the other surface, and arranged such that the hydrophilic layers face each other.

The distance between the membranes can be controlled according to the size of the protrusions provided on the polyimide films: for example, when the height of the protrusions is 1 mm, the distance between the films is 1 mm.

The two films are then laminated and wound up to form a wick, and a heat pipe provided inside with the wick is manufactured.

In the wick formed by winding up the porous membranes, a working fluid exists in a region (1 mm wide) sandwiched between the hydrophilic layers, and vapor alone exists in a region (1 mm wide) sandwiched between the water-repellent layers, which region the working fluid (e.g., water) is not able to enter. This structure, in which the membranes separate a vapor passage from a working fluid passage, can achieve an improved emission limit, leading to an improved transfer limit.

INDUSTRIAL APPLICABILITY

The present invention can provide a heat pipe that can achieve an improved emission limit compared to those of conventional heat pipes.

DESCRIPTION OF SYMBOLS

1: Heat pipe of the present invention
10: Wick
11: Hydrophilic treated first surface
12: Water-repellent treated second surface
13: Casing
20: Porous membrane
30: Heating unit
40: Cooling unit

The invention claimed is:

1. A heat pipe comprising:

an inside; and a wick provided in the inside and formed of a porous membrane, the porous membrane having a hydrophilic treated first surface and a water-repellent treated second surface, wherein the porous membrane separates a working fluid passage from a vapor passage such that the hydrophilic treated surface faces the working fluid passage and the water-repellent treated surface faces the vapor passage, and wherein at least a portion of the porous membrane is folded once such that the hydrophilic treated surfaces face each other, and then the folded porous membrane is wound.

2. The heat pipe according to claim 1, wherein the porous membrane is folded multiple times such that surfaces subjected to the same treatment face each other.

3. A heat pipe comprising:

an inside; and a wick provided in the inside and formed of at least two porous membranes each having a hydrophilic treated first surface and a water-repellent treated second surface, wherein the at least two porous membranes separate a working fluid passage from a vapor passage such that each of the hydrophilic treated first surfaces face the working fluid passage and each of the water-repellent treated second surfaces face the vapor passage, and wherein the at least two porous membranes are laminated such that surfaces subjected to the same treatment face each other and then the laminates is wound.

4. A heat pipe comprising:

an inside; and a wick provided in the inside and formed of a porous membrane, the porous membrane having a hydrophilic treated first surface and a water-repellent treated second surface, wherein the porous membrane separates a working fluid passage from a vapor passage such that the hydrophilic treated surface faces the working fluid passage and the water-repellent treated surface faces the vapor passage, wherein at least a portion of the porous membrane is folded so as to include a folded crease that is disposed in parallel to a direction of flow in each of the working fluid passage and the vapor passage.

* * * * *